US010150596B2

(12) United States Patent
Di Giuseppantonio et al.

(10) Patent No.: US 10,150,596 B2
(45) Date of Patent: Dec. 11, 2018

(54) CONTAINER FOR FOOD WITH A SEALING LID

(71) Applicant: BORMIOLI LUIGI S.P.A., Parma (IT)

(72) Inventors: Vincenzo Di Giuseppantonio, Fidenza (IT); Luca Camminati, Fiorenzuola D'Arda (IT)

(73) Assignee: BORMIOLI LUIGI S.P.A., Parma (IT)

( * ) Notice: Subject to any disclaimer, the term of this patent is extended or adjusted under 35 U.S.C. 154(b) by 0 days.

(21) Appl. No.: 15/427,885

(22) Filed: Feb. 8, 2017

(65) Prior Publication Data

US 2017/0225847 A1 Aug. 10, 2017

(30) Foreign Application Priority Data

Feb. 10, 2016 (IT) ..... 102016000013736

(51) Int. Cl.
*B65D 45/06* (2006.01)
*B65D 53/02* (2006.01)
*B65D 51/14* (2006.01)

(52) U.S. Cl.
CPC ..... *B65D 45/06* (2013.01); *B65D 51/145* (2013.01); *B65D 53/02* (2013.01); *B65D 2543/00305* (2013.01); *B65D 2543/00564* (2013.01)

(58) Field of Classification Search
CPC ..... B65D 45/06; B65D 45/04; B65D 45/22; B65D 45/20; B65D 45/16; B65D 45/32; B65D 53/02; B65D 53/00; B65D 51/24; B65D 25/28; B65D 39/00; B65D 39/0058; B65D 39/16; B65D 51/145; B65D 51/14

(Continued)

(56) References Cited

U.S. PATENT DOCUMENTS 353,503 A * 11/1886 Rehfuss ..... B65D 45/22 215/286
1,413,592 A * 4/1922 Kozlosky ..... B65D 45/34 215/272

(Continued)

FOREIGN PATENT DOCUMENTS

CH 127754 A 9/1928
DE 195865 C 2/1908

(Continued)

OTHER PUBLICATIONS

Italian Patent Office Search Report dated Oct. 28, 2016.

*Primary Examiner* — Robert J Hicks
(74) *Attorney, Agent, or Firm* — Hedman & Costigan, P.C.; James V. Costigan; Kathleen A. Costigan

(57) ABSTRACT

A container provided with a sealing lid comprises a jar (11), a lid (12) for closing the jar, a rubber sealing ring (13), adapted to be interposed between an upper edge (17) of the jar (11) and a lower flange (18) of the lid (12), and a wire-shaped hooking element (14) of the lid (12) to the jar (11) for closing the container. The jar (11) is provided, in the proximity of its upper edge (17), with a collar (21) radially projecting from the jar side surface (22) so as to define below a circumferential step-like seat (23). The wire-shaped hooking element (14) is shaped with a pair of pivoting ends (20) rotatably received inside respective holes (19) in the lid (12) and with at least one curvilinear locking portion (24), in an intermediate position with respect to said pivoting ends (20).

10 Claims, 4 Drawing Sheets

(58) Field of Classification Search
USPC ..... 215/286, 280, 273, 284, 285, 228, 346, 215/359, 358, 355; 220/321, 320, 319, 220/315, 756, 752, 212.5, 212, 326, 324, 220/804, 803, 802, 801, 806, 796; 53/471, 489, 485, 484
See application file for complete search history.

(56) References Cited

U.S. PATENT DOCUMENTS

| | | | | | |
|---|---|---|---|---|---|
| 1,575,556 | A * | 3/1926 | Eick | B65D 45/24 | 215/239 |
| 1,951,559 | A * | 3/1934 | Pyott | B65D 45/24 | 215/316 |
| 2,279,991 | A * | 4/1942 | Hotchkiss | B65D 45/02 | 215/280 |
| 2,375,388 | A * | 5/1945 | Ryan | B65D 53/02 | 215/352 |
| 2,380,443 | A * | 7/1945 | Ingie | B65D 45/28 | 215/290 |
| 3,076,576 | A * | 2/1963 | Cornelius | B65D 45/16 | 220/243 |
| 3,132,760 | A * | 5/1964 | Dellinger | B65D 25/32 | 215/287 |
| 4,629,084 | A | 12/1986 | Hackelsberger | | |
| 2017/0015462 | A1 * | 1/2017 | Roth | B65D 45/06 | |
| 2017/0015465 | A1 * | 1/2017 | Raupach | B65D 21/0217 | |
| 2017/0190480 | A1 * | 7/2017 | Liberati | B65D 45/24 | |

FOREIGN PATENT DOCUMENTS

| | | | |
|---|---|---|---|
| DE | 902213 | C | 1/1954 |
| FR | 475715 | A | 6/1915 |

* cited by examiner

CONTAINER FOR FOOD WITH A SEALING LID

The present invention relates to a container, advantageously a glass jar, provided with a lid with sealing closure for the storage of food contained therein.

For the storage of foods, in particular vacuum storage, various types of containers are used, essentially consisting of a jar, a sealing lid, means adapted to ensure the hermetic seal of the closure and releasable constraining means of the lid with respect to the jar.

A type of containers used for this purpose consists of jars provided with the so-called "twist-off" capsule, or screw capsule. These are glass jars with a threaded neck, on which a threaded metal lid is screwed having, at the inner portion thereof intended to adhere to the edge of the jar neck, a glue permeable to gases and impermeable to liquids. Due to this feature, the air contained in the jar expands during sterilization and escapes through the pores of the glue, however no water can enter inside the jar, thus forming a vacuum inside. The vacuum inside the jar is shown by the lowering of the central portion (usually made flexible) of the capsule which, at the opening of the container, produces a typical metallic snap.

This type of container has the advantage of allowing completely separating the lid from the jar, with obvious benefits in the process of extraction of the food from the jar and during the cleaning of the same, however the sealing capsule which forms the sealing lid must be replaced at each vacuum storage cycle.

Another type of container used in the prior art provides separate jar and lid, made of glass, with an interposed rubber sealing ring. The lid and the jar are held closed by means of single spring metal clips, applied so as to compress the lid and the jar towards each other, thereby sealingly tightening the sealing ring between the respective peripheral edges. This type of container is described, for example, in U.S. Pat. No. 4,629,084.

This type of container also has the advantage of allowing easy access and cleaning of the interior of the jar, however the clips can be lost since they are not stably constrained to the jar or to the lid.

A further type of container, widely used, is one which provides glass lid and jar, bound together by a metal element made of steel wire, comprising a first portion anchored to the jar and a second portion anchored to the lid and hinged to said first portion to allow the turning movement of the lid from the closed position to the open position. The metal element further comprises a hooking mechanism consisting of a lever system hinged to the first portion anchored to the jar and adapted to hook to the second portion anchored to the lid, thus compressing the lid towards the jar and tightening a rubber sealing ring therebetween, advantageously stably applied to the peripheral edge of the lid.

This container provides excellent sealing tightness in each vacuum storage cycle, however the lid is hardly separable from the jar and, therefore, an effective cleaning action may be difficult.

The general object of the present invention is to remedy the above drawbacks by providing a container adapted for storing food under vacuum, or with hermetic seal, which combines excellent sealing features of the lid with respect to the jar and a complete separability of the lid from the jar to allow an effective cleaning and handling action.

In view of such an object, a container has been implemented, according to the invention, provided with a sealing lid, comprising a jar, a lid for closing the jar, a rubber sealing ring, intended to be interposed between an upper edge of the jar and a lower flange of the lid, and a wire-shaped hooking element for hooking the lid to the jar in order to close the container, characterized in that the jar is provided, in the proximity of its upper edge, with a collar radially projecting from the jar side surface so as to define below a circumferential step-like seat, and said wire-shaped hooking element is shaped with a pair of pivoting ends rotatably received inside respective holes in the lid and with at least one curvilinear locking portion, in an intermediate position with respect to said pivoting ends, designed to embrace the side surface of the jar when it is inserted into the circumferential step-like seat below the projecting collar, abutting against the lower surface of the collar.

To make the explanation of the innovative principles of the present invention and its advantages with respect to the prior art clearer, a possible embodiment applying said principles is described hereinafter with the aid of the accompanying drawings. In the drawings.

Figure 1:
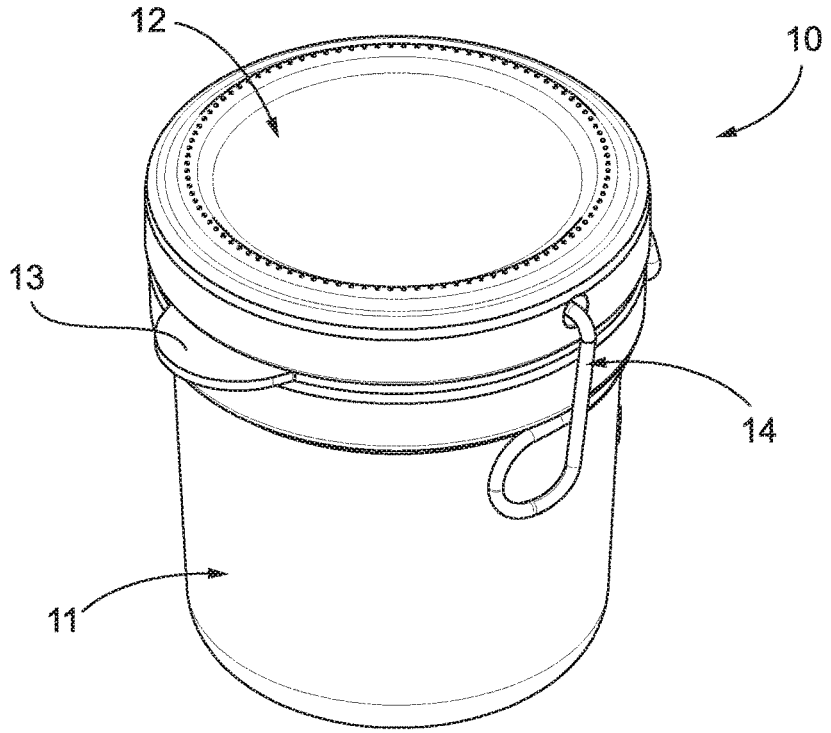
FIG. 1 is an overall view of the container according to the invention, in closed position.

With reference to the figures, the container 10 according to the invention comprises a jar 11, a lid 12, a rubber sealing ring 13 and a suitably shaped wire-shaped hooking element 14. The jar 11 and the lid 12 are advantageously made of glass. The hooking element 14 is advantageously made of a stainless steel elastic wire.

Figure 4:
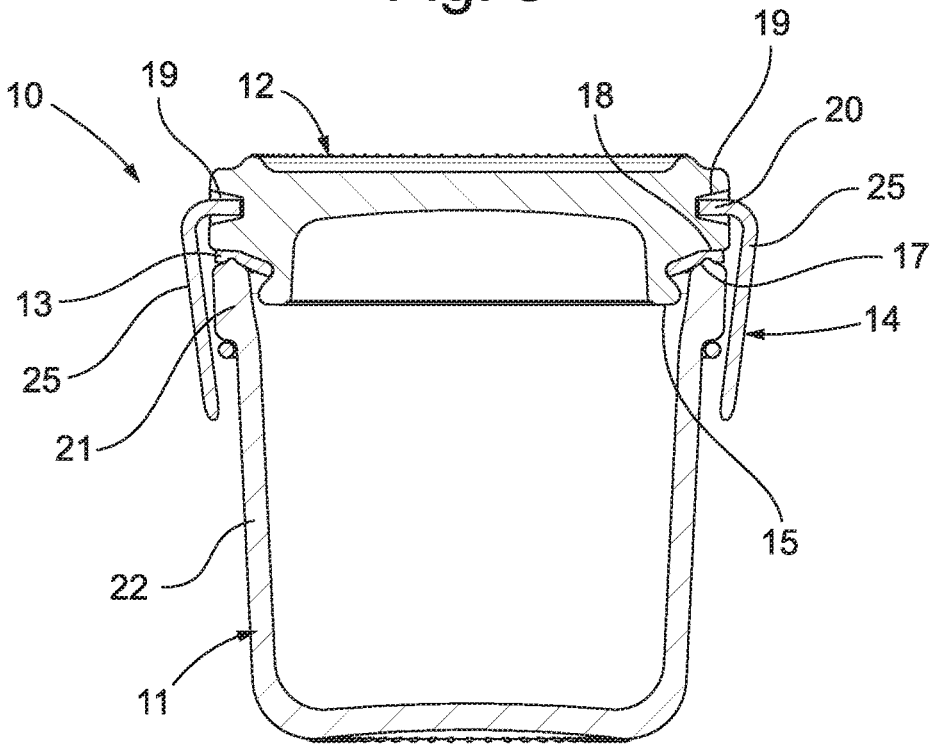
FIG. 4 is a sectional view of the container as shown in FIG. 3.
Figure 5:
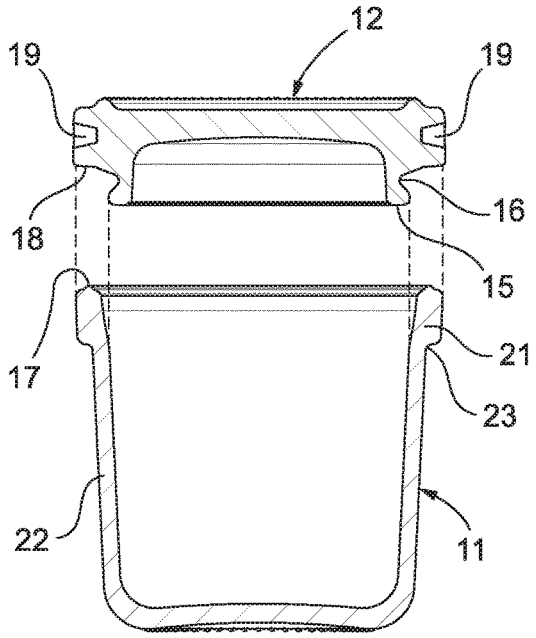
FIG. 5 is a sectional view of the jar and the lid of the container of FIG. 1.
Figure 6:
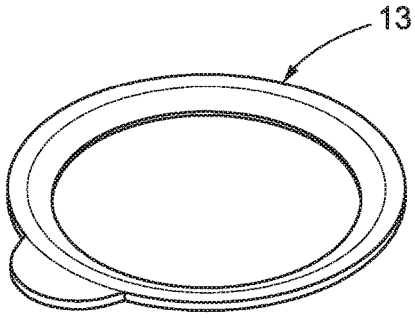
FIG. 6 shows the sealing element of the container of FIG. 1.

As is seen in more detail in FIG. 5, lid 12 is provided, in the proximity of its lower edge 15, with a circumferential groove 16 designed to form a receiving seat for the sealing ring 13 intended to remain interposed, when the container is closed, between the upper edge 17 of the jar 11 and a lower flange 18 of the lid 12, as is well seen in the assembled section of FIG. 4.

The lid 12 is further provided with anchoring seats for the hooking element 14. In particular, these seats consist of a pair of side holes 19, advantageously arranged in a diametrically opposed position on the side surface of the lid.

Said holes 19 are intended to receive respective pivoting ends 20 of the wire-shaped hooking element 14, as shown in FIG. 4.

The jar 11 is provided, in the proximity of its upper edge 17, with a collar 21 radially projecting from the side surface 22 thereof so as to define below a circumferential step-like seat 23 adapted to receive, with snap-engagement, a locking portion of the hooking element 14 for stably constraining said hooking element to the jar when the container is in the closed condition.

Figure 7:
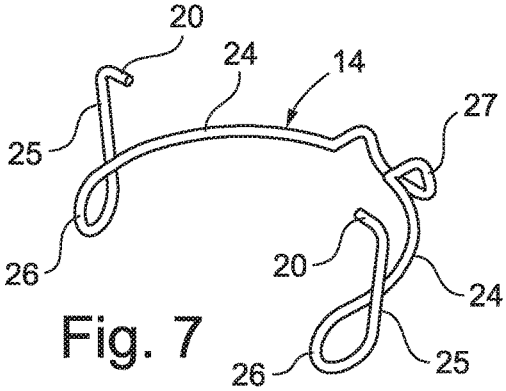
FIG. 7 shows the hooking element of the container of FIG. 1.
Figure 8:
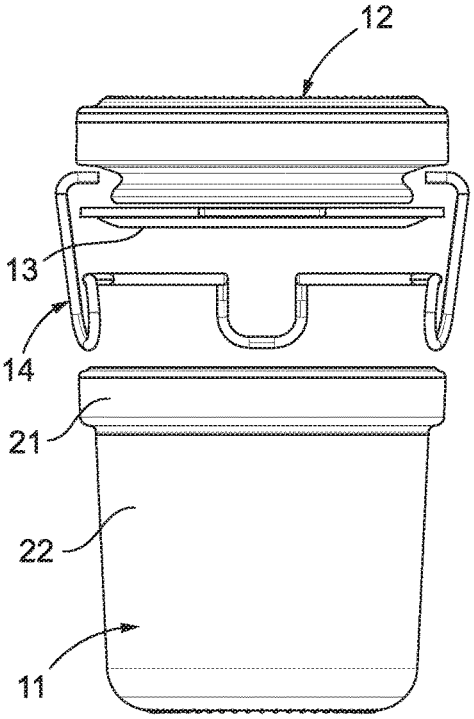
FIG. 8 is an exploded view of the container as shown in FIG. 3.
Figure 9:
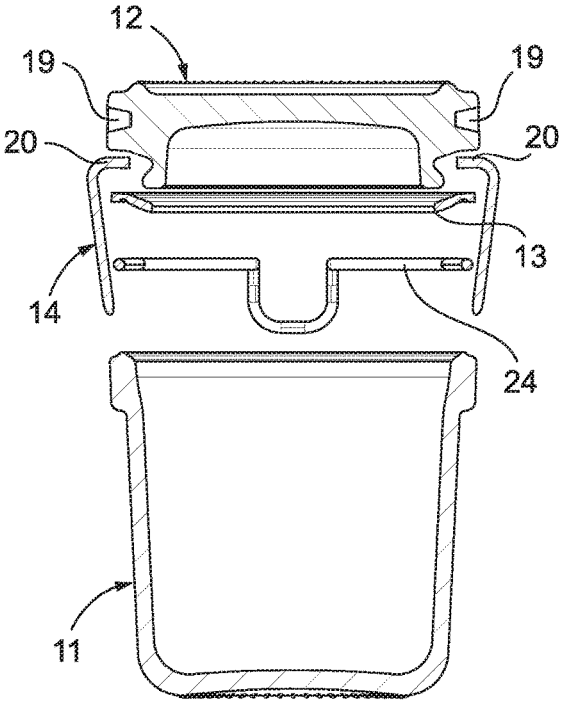
FIG. 9 is an exploded sectional view of the container of FIG. 8.

As is clearly shown in FIG. 7, the hooking element 14 consists of a metal wire comprising at least one curvilinear locking portion 24 coaxial to jar 11 when it is in the locking position, adapted to embrace the side surface 22 of the jar by inserting stably in the circumferential step-like seat 23 below the projecting collar 21, in abutment against the lower surface of the collar.

By "stably" it is of course meant, as easily understood by the person skilled in the art, that the curvilinear locking portion 24 cannot move away from said position without an external action (by the user) which elastically forces the metal wire, thus causing the exit of the locking portion 24 from seat 23.

Said at least one curvilinear locking portion 24 advantageously embraces the side surface 22 of the jar for about half the circumference of the jar. For convenience of terminology, in the present description the part of the jar (and, more generally, of the container) at which said at least one curvilinear locking portion 24 embraces the side surface 22 of the jar will be defined as "front side" (shown in FIG. 2), while the opposite part will be defined as "rear side" (shown in FIG. 3).

The wire-shaped hooking element 14 further comprises a pair of portions 25 for connection with the lid 12, which diverge upwardly from said at least one curvilinear locking portion 24 and end into the ends 20 pivotally connected to the side holes 19 provided in the lid 12. Said at least one curvilinear locking portion 24 is thus intermediate to the portions 25 for connection with the lid.

Figure 2:
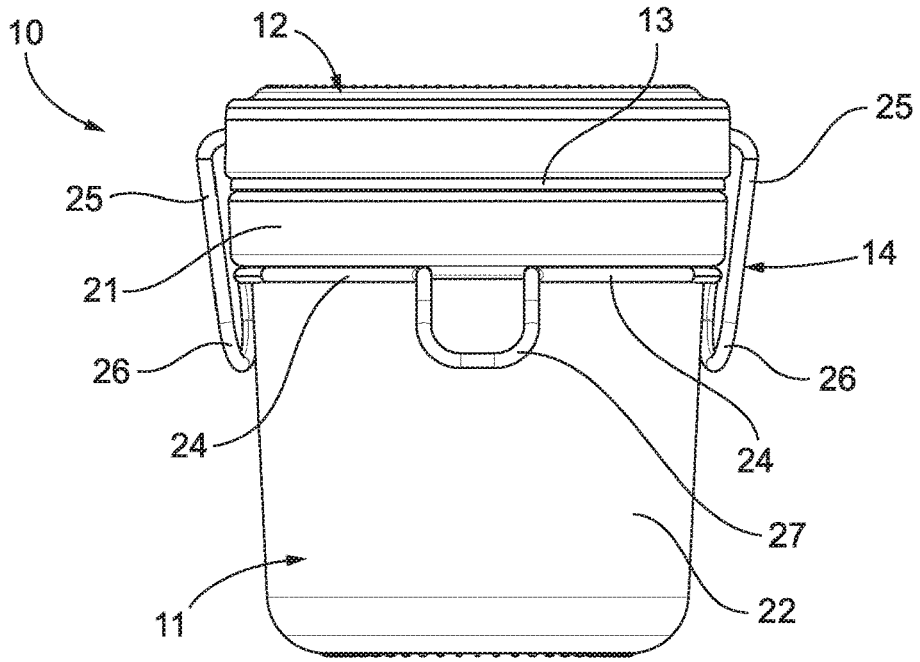
FIG. 2 is an elevational view of the front side of the container of FIG. 1.
Figure 3:
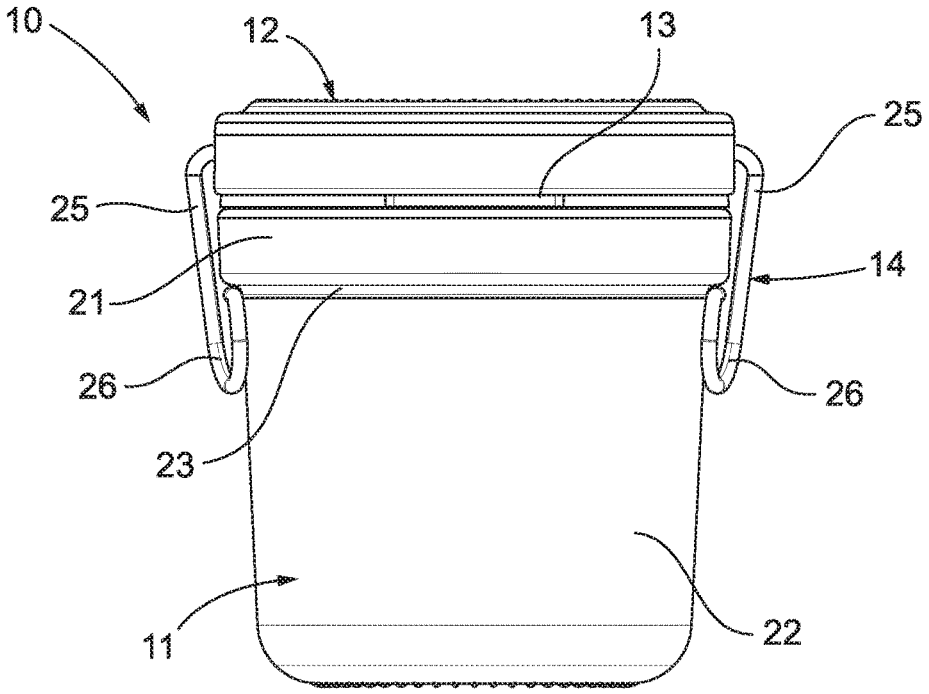
FIG. 3 is an elevational view of the rear side of the container of FIG. 1.
Figure 11:
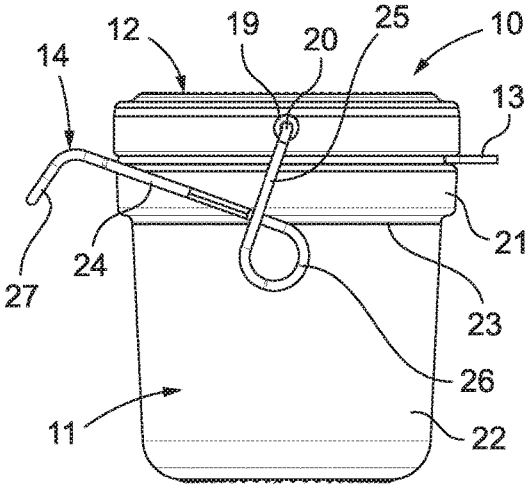
FIG. 11 is a side elevational view of the container in partially unlocked lid condition.
Figure 12:
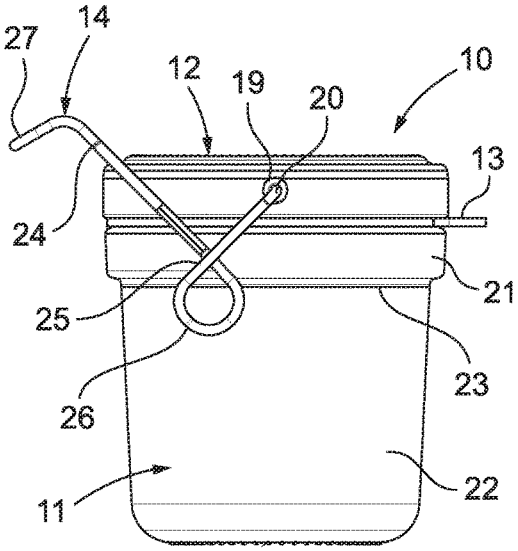
FIG. 12 is a side elevational view of the container in fully unlocked lid condition.

Advantageously, each connecting portion 25 diverges from the curvilinear locking portion 24 through a respective eyelet-shaped, metallic wire-shaped section 26 (which is clearly shown in FIG. 7 and in FIGS. 10-12) which allows the axis of the wire-shaped hooking element 14 to get away from the side surface 22 of the jar (which is embraced by said locking portion 24), beyond the width of collar 21, so that the connecting portions 25 do not interfere with the collar 21, as is visible in FIG. 2 and FIG. 3.

The wire-shaped hooking element 14 is thus stably constrained to the lid 12 (through the pivoting ends 20 thereof, inserted in the side holes 19 of the lid), as well as the sealing ring 13 (accommodated in the circumferential groove 16 of the lid), while it remains only temporarily constrained to the jar 11 (through the snap engagement of the at least one curvilinear locking portion 24 in the circumferential step-like seat 23 below the collar 21) when the container is in the closed condition.

The position taken by the wire-shaped hooking element 14 when it is snap-engaged in the circumferential step-like seat 23 is defined hereinafter as "lowered position". In such a lowered position (shown in FIGS. 1-4 and in FIG. 10), the wire-shaped hooking element 14 reacts on one hand on the lid 12 at the pivoting ends 20 thereof inserted in the holes 19 and on the other hand on the jar 11, at the at least one curvilinear locking portion 24 in abutment against the lower surface of the projecting collar 21, thus compressing the lid 12 and jar 11 against each other with the sealing ring 13 interposed therebetween to ensure the sealing of the container.

Figure 10:
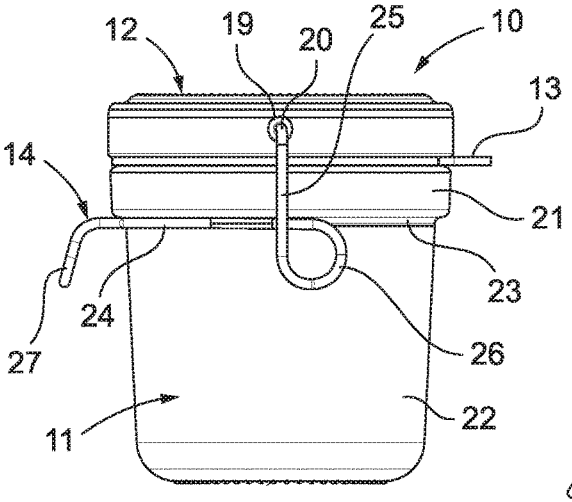
FIG. 10 is a side elevational view of the container in locked lid condition.

In order to open the container, starting from the condition of FIG. 10, it is necessary to rotate the wire-shaped hooking element 14 upwards, thus forcing said at least one curvilinear locking portion 24 to disengage from the circumferential step-like seat 23 and to embrace with interference the side surface of the collar 21. The forced passage from the engagement position of the curvilinear locking portion 24 in the circumferential step-like seat 23 to the disengaged position in which it embraces the collar 21 (which has a larger diameter than said seat 23) is allowed by the elasticity that the wire-shaped hooking element 14 naturally possesses at least at the curvilinear locking portion 24. The position taken by the wire-shaped hooking element 14 when embracing with interference the side surface of the collar 21 (shown in FIG. 11) may be defined as "raised intermediate position with interference".

This first rotation movement of the wire-shaped hooking element 14 around the pivoting points of its ends 20 in holes 19 between the lowered position and the raised position with interference may be obtained, for example, by pushing the eyelet portions 26 towards the front side of the container.

Advantageously, in order to facilitate the forced disengagement of the wire-shaped hooking element 14 from the circumferential step-like seat 23, an engagement portion 27 may be provided, centrally arranged in an intermediate position of the wire-shaped element 14 and forwardly projecting therefrom. In particular, with this configuration, two curvilinear locking portions 24 will be present in the wire-shaped hooking element 14, separated from each other by said projecting engagement portion 27, which together embrace the side surface of the jar for about half of its circumference.

Figure 13:
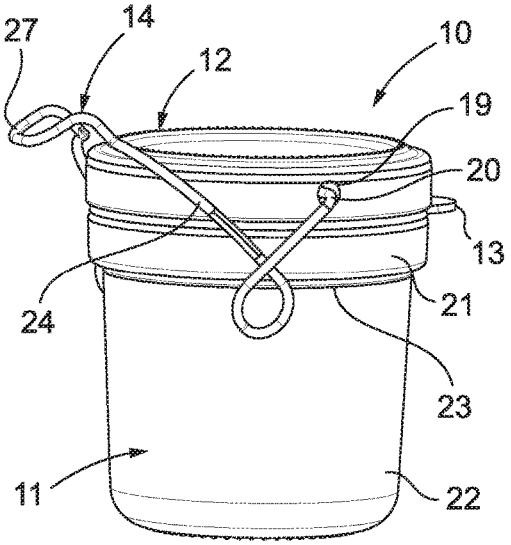
FIG. 13 is an axonometric view of the container in the condition of FIG. 12.

This projecting portion 27 may be easily engaged by the user's fingers to be pushed upwards, acting as a disengagement lever for the curvilinear locking portions 24 from the circumferential step-like seat 23. Once said at least one curvilinear locking portion 24 has been disengaged from the circumferential step-like seat 23, in order to enable the opening of the container, the wire-shaped hooking element 14 must be further rotated upwardly until the curvilinear locking portion 24 no longer embraces the side surface of the collar 21. This further raised position (shown in FIG. 12 and in FIG. 13) taken by the wire-shaped hooking element 14 when the at least one curvilinear locking portion 24 is arranged above the collar 21 and no longer interferes therewith, may be defined as "free raised position".

At this point, the wire-shaped hooking element 14 is released from the jar and the lid 12 can be freely separated from the jar 11.

In order to close the container, one proceeds in the reverse manner: the lid 12 is placed on the upper edge of the jar 11 with the wire-shaped hooking element 14 in said "free raised position" (FIGS. 12 and 13), the wire-shaped hooking element 14 is lowered (advantageously by acting on the projecting engagement portion 27) to the "intermediate raised position with interference", in which the curvilinear locking portion 24 embraces the side surface of the collar 21 (FIG. 11), and finally the wire-shaped hooking element 14 is further rotated up to its lowered position, in which the curvilinear locking portion 24 snaps into the circumferential step-like seat 23, thus embracing the side surface 22 of jar 11 (FIG. 10).

It is clear at this point that the intended objects are achieved by providing a container adapted for the vacuum storage of food which, while ensuring excellent sealing tightness due to the compression of the lid against the jar with the interposed rubber sealing ring, allows completely separating the lid from the jar (with the apparent advantages in terms of accessibility inside the jar, also for cleaning), while obtaining only two independent components (jar and lid), since the sealing ring and the wire-shaped hooking element are stably constrained to the lid and there is therefore no risk that they may be lost.

Of course, the above description of an embodiment applying the innovative principles of the present invention is given by way of example of such innovative principles and therefore must not be taken as a limitation of the patent right claimed herein.

For example, the wire-shaped hooking element, herein described as a metal wire (advantageously stainless steel), may be made of a similar material as regards mechanical and functional features, for example with a metal core coated with a protective plastic material.

Instead of glass, the jar and the lid may also be made of other materials suitable for food storage, such as plastic, metal or ceramic materials.

The invention claimed is:

1. Container provided with a sealing lid, comprising a jar (11), a lid (12) for closing the jar, a rubber sealing ring (13), intended to be interposed between an upper edge (17) of the jar (11) and a lower flange (18) of said lid (12), and a wire-shaped hooking element (14) for hooking said lid (12) to said jar (11) in order to close said container, said jar (11) being provided, in the proximity of its upper edge (17), with a projecting collar (21) radially projecting from a jar side surface (22) so as to define a circumferential step seat (23) below said projecting collar (21), and said wire-shaped hooking element (14) being shaped with a pair of pivoting ends (20) rotatably received inside respective holes (19) in the lid (12) with two curvilinear locking portions (24) in an intermediate position with respect to said pivoting ends (20) and an engagement portion (27) of said wire-shaped hooking element (14), said wire-shaped hooking element (14) being rotatable at said pair of pivoting ends (20) between:

a lowered position in which said two curvilinear locking portions (24) are stably received in said circumferential step seat (23) below said projecting collar (21), said curvilinear locking portions (24) abutting a lower surface of said projecting collar (21) and a raised position in which said two curvilinear locking portions (24) do not interfere with said jar (11), characterized in that when said wire-shaped hooking element (14) which comprises said two curvilinear locking portions (24) is in said lowered position, said two curvilinear locking portions (24) of said wire-shaped hooking element (14) embrace said jar side surface (22) for about half of a circumference of said jar side surface (22), and said wire shaped hooking element (14) is provided with said engagement portion (27) that is centrally arranged in said intermediate position of said wire-shaped hooking element (14) where said engagement portion (27) projects outwardly from said wire-shaped hooking element (14).

2. Container according to claim 1, characterized in that between said lowered position and said raised position of the wire-shaped hooking element (14) there is an intermediate position in which said two curvilinear locking portions (24) of said wire-shaped hooking element (14) embraces with interference said side jar surface (22) of said projecting collar (21) of said jar (11).

3. Container according to claim 2, characterized in that the switching of said wire-shaped hooking element (14) from said intermediate position with interference to said lowered position causes the at least one said two curvilinear locking portions (24) to engage said circumferential step seat (23).

4. Container according to claim 1, characterized in that the said holes (19) in said lid (12) for receiving said pivoting ends (20) of said wire-shaped hooking element (14) are arranged in diametrically opposed positions on a side surface of said lid (12).

5. Container according to claim 1, characterized in that said two curvilinear locking portions (24) are coaxial to said jar (11) when said two curvilinear locking portions (24) are in said lowered position.

6. Container according to claim 1, characterized in that said wire-shaped hooking element (14) comprises a pair of connecting portions (25) for the connection to said lid (12), which diverge upwardly from said two curvilinear locking portions (24) and end in said pivoting ends (20) rotatably received in respective holes (19) of said lid (12).

7. Container according to claim 6, characterized in that each one of said pair of connecting portions (25) diverges from said two curvilinear locking portions (24) through a respective eyelet-shaped wire-shaped section (26) which allows the axis of said wire-shaped hooking element (14) to separate from said jar side surface (22), which is embraced by said at least one locking portion (24), beyond the width of said projecting collar (21), so that said pair of connecting portions (25) do not interfere with said projecting collar (21).

8. Container according to claim 1, characterized in that said lid (12) is provided, in the proximity of a lower edge (15) of said lid (12), with a circumferential groove (16) designed to form a receiving seat for said rubber sealing ring (13) that remains interposed, between said upper edge (17) of said jar (11) and said lower flange (18) of said lid (12) when said container is closed.

9. Container according to claim 1, characterized in that said wire-shaped hooking element (14) is made of a stainless steel wire.

10. Container provided with a sealing lid, comprising a jar (11), a lid (12) for closing the jar, a rubber sealing ring (13), intended to be interposed between an upper edge (17) of the jar (11) and a lower flange (18) of said lid (12), and a wire-shaped hooking element (14) for hooking said lid (12) to said jar (11) in order to close said container, said jar (11) being provided, in the proximity of its upper edge (17), with a projecting collar (21) radially projecting from said jar side surface (22) so as to define a circumferential step seat (23) below said projecting collar (21), and said wire-shaped hooking element (14) being shaped with a pair of pivoting ends (20) rotatably received inside respective holes (19) in the lid (12) with two curvilinear locking portions (24) each connected to a pair of portions (25) connected to each of said pivoting ends (20) for connection to said lid (12); said two curvilinear locking portions (24) being in an intermediate position with respect to said pivoting ends (20) and an engagement portion (27) of said wire-shaped hooking element (14), said wire-shaped hooking element (14) being rotatable at said pair of pivoting ends (20) between:

a lowered position in which said two curvilinear locking portions (24) are stably received in said circumferential step seat (23) below said projecting collar (21), said curvilinear locking portions (24) abutting a lower surface of said projecting collar (21) and a raised position in which said two curvilinear locking portions (24) do not interfere with said jar (11), characterized in that when said wire-shaped hooking element (14) which comprises said two curvilinear locking portions (24) is in said lowered position, said two curvilinear locking portions (24) of said wire-shaped hooking element (14) embrace said jar side surface (22) for about half of a circumference of said jar side surface (22), and said wire shaped hooking element (14) is provided with said engagement portion (27) that is centrally arranged in an intermediate position of said wire-shaped hooking element (14) where said engagement portion (27) projects outwardly from said wire-shaped hooking element (14).

* * * * *